US005454649A

United States Patent [19]

Cattaneo

[11] Patent Number: 5,454,649

[45] Date of Patent: Oct. 3, 1995

[54] WIRE PRINTHEAD WITH ARMATURE BIASING MECHANISM

[75] Inventor: Sergio Cattaneo, Milan, Italy

[73] Assignee: Bull HN Information Systems Italia S.p.A., Turin, Italy

[21] Appl. No.: 227,793

[22] Filed: Apr. 14, 1994

[30] Foreign Application Priority Data

Apr. 28, 1993 [EP] European Pat. Off. ..... 93830182

[51] Int. Cl.[6] ..... B41J 2/275

[52] U.S. Cl. ..... 400/124.21; 400/124.23

[58] Field of Search ..... 400/124, 124.21, 400/124.22, 124.23

[56] References Cited

U.S. PATENT DOCUMENTS

| | | | |
|---|---|---|---|
| 3,892,175 | 7/1975 | Heindke et al. | 400/124.33 |
| 4,204,778 | 5/1980 | Miyazawa et al. | 400/124 |
| 4,260,270 | 4/1981 | Cavallari | 400/124.22 |
| 4,600,321 | 7/1986 | Kwan | 400/124.22 |
| 4,643,598 | 2/1987 | Pruski | 400/124.22 |
| 4,793,252 | 12/1988 | Pilcher | 400/124.22 |
| 4,886,381 | 12/1989 | Kersey | 400/124.22 |
| 5,000,593 | 3/1991 | Gugel et al. | 400/124.21 |
| 5,054,942 | 10/1991 | Bernardis et al. | 400/124.21 |

FOREIGN PATENT DOCUMENTS

| | | | |
|---|---|---|---|
| 0141522 | 5/1985 | European Pat. Off. | 400/124 |
| 0139217 | 5/1985 | European Pat. Off. | 400/124 |
| 0418433 | 3/1991 | European Pat. Off. | 400/124 |
| 56-058883 | 5/1981 | Japan | 400/124.22 |
| 57-103858 | 6/1982 | Japan | 400/124.24 |
| 57-126671 | 8/1982 | Japan | 400/124.17 |
| 58-187375 | 11/1983 | Japan | 400/124.17 |
| 59-087179 | 5/1984 | Japan | 400/124.22 |
| 59-224365 | 12/1984 | Japan | 400/124.23 |
| 61-266259 | 11/1986 | Japan | 400/124 |
| 62-249755 | 10/1987 | Japan | 400/124.13 |
| 63-297054 | 12/1988 | Japan | 400/124 |
| 3-082552 | 4/1991 | Japan | 400/124.22 |
| 5-147233 | 6/1993 | Japan | 400/124.22 |

*Primary Examiner*—David A. Wiecking
*Attorney, Agent, or Firm*—Morgan & Finnegan

[57] ABSTRACT

A wire printhead comprising a plurality of electromagnets and a corresponding plurality of armatures, each provided with an actuator arm forming, with the juxtaposed armature to an electromagnet, a lever of first order for actuating an impression wire attached to a free end of the actuator arm, said lever being biased to the rest position by a flexurally pre-loaded leaf spring acting on the lever in a predetermined position with respect to the lever fulcrum, through a resilient element which defines the point of application to the lever of the force from the leaf spring.

8 Claims, 4 Drawing Sheets

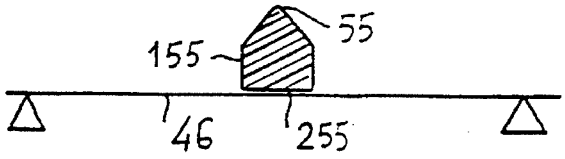
FIG. 4
FIG. 5
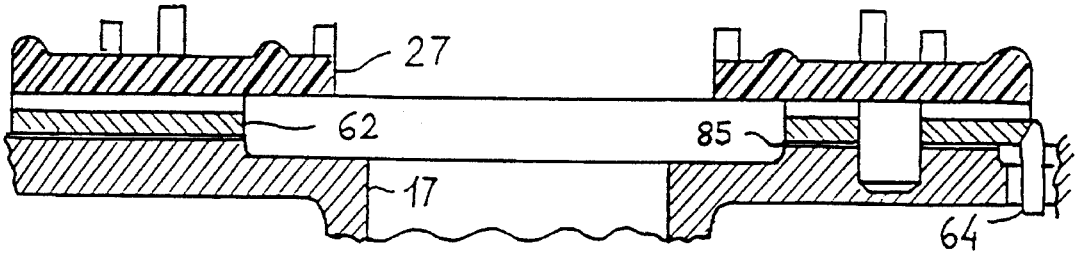
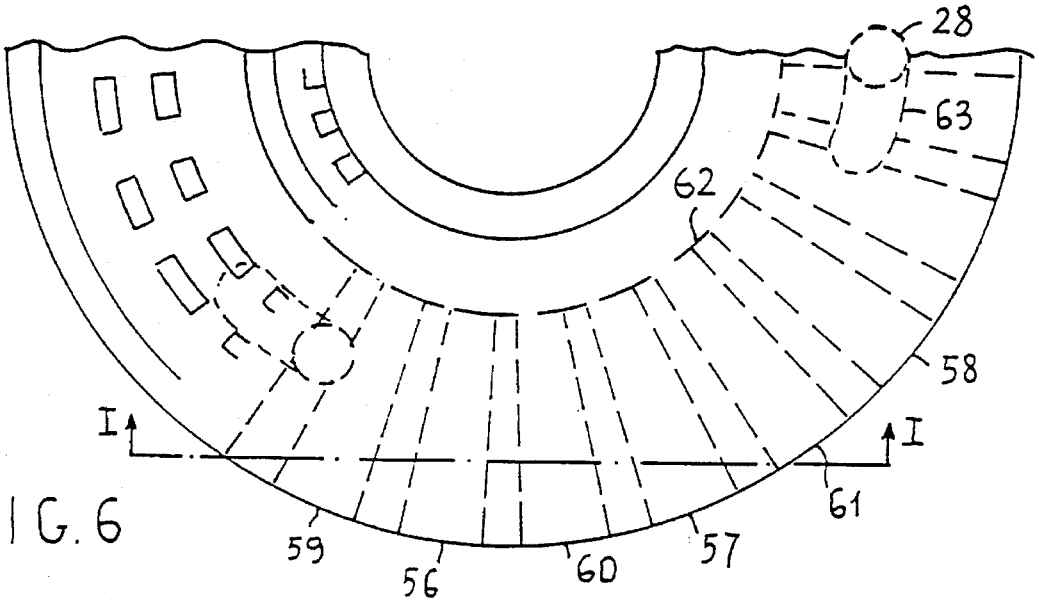
FIG. 6
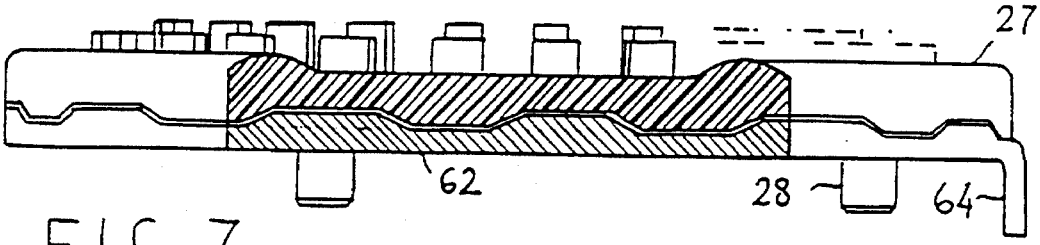
FIG. 7

WIRE PRINTHEAD WITH ARMATURE BIASING MECHANISM

BACKGROUND OF THE INVENTION

This invention relates to a wire printhead of the kind used in dot matrix impact printers employed as peripheral printer units in data processing systems and personal calculators or PCs.

DESCRIPTION OF THE PRIOR ART

Known are wire printheads wherein a plurality of moving electromagnet armatures are each provided with an actuator arm whose end is coupled to a printing element in wire form.

The several armatures are generally arranged to lie in one plane and extend radially around a perpendicular axis to said plane, with the actuator arms being terminated the closest possible to said axis.

This axis is by universal convention agreed to be the head axis.

The print wires generally extend along said axis direction and are given the least possible amount of curvature and run to a single print wire with their remote ends from the actuator arms.

The print wires may each be joined as by soldering or welding, to one actuator arm, into an arm/wire unit, or may be coupled dynamically thereto.

In that case, the wire end joined to the actuator arm is provided with a head acting as an abutment member for a compression spring being wound around the wire end to bias the head and wire toward the actuator arm.

Additionally to biasing the wire toward the actuator arm, the compression spring acts as a mechanical polarization member for the armature by constraining it to a rest position with a predetermined force, easy to control.

The armature is moved from the rest position to an active position by the energization of an associated electromagnet.

The actuator arm/wire unitary construction is to be preferred because it reduces the number of the printhead parts, simplifies the assembly operations, and enables the actuator arms to be best clustered together so as to minimize the wire bending, and eventually the wire lengths.

The net result is a highly compact printhead design.

The tradeoff of the unitary actuator arm/wire construction is that, absent the action from the compression spring ensuring the arm-to-wire dynamic coupling, a mechanical polarization must be provided for the armatures in order to retain them in the rest position.

In the instance of printheads wherein the armatures and associated arms form, in combination with the electromagnets associated therewith, levers FPR of third order, the mechanical polarization of the armatures can be readily implemented by constructing the fulcrum as a joint having predetermined rigidity.

Thus, armature release printheads (with or without a permanent magnet) can be provided, as well as armature attraction printheads wherein the arm/wire combination is a unitary construction.

In the instance of printheads wherein the armatures and their arms form, in combination with their associated electromagnets, levers of first order (PFR), the armature mechanical polarization cannot be readily provided by an elastic fulcrum bond, and requires that elastic polarization elements be arranged to act on either the power or the weight arm, which increases constructional complexity, assembly difficulties, and cost of the printhead.

Also known are printheads whose armatures and associated actuator arms form levers of first order, simply arranged to bear each on an edge of a magnetic pole acting as the fulcrum.

The armatures are held in contact with the edge of the corresponding magnetic poles by a resilient element in the form of an O-ring juxtaposed to the various edges at the remote end from the armatures.

This element applies to the armatures a thrust force adequate to prevent the armatures from being lifted off the edge, while allowing them to pivot partway about the edge without any relative displacements of contact surfaces taking place, that is with no frictional resistance and wear.

The elastic bond thus provided is effective, simple, inexpensive, highly reliable and long-lived.

However, it cannot be used as a means of mechanical polarization of the armatures to a rest position because the thrust from the bond is hard to control, and accordingly, that bond is used on printheads having an armature-to-wire coupling of the dynamic type.

SUMMARY OF THE INVENTION

Such limitations to prior art printheads are overcome by a printhead according to this invention, wherein the print wires are assembled unitarily to corresponding armatures and the latter form levers of first order, wherein it is the fulcrum bond itself, as imposed by an O-ring, which applies, in a controlled, repetitive and reproducible manner, the required mechanical polarization of the armatures to hold them in the rest position.

In accordance with the invention, this is obtained by providing the O-ring with an elastic intermediate support, juxtaposed to each armature, said elastic intermediate having a much smaller elastic constant than the O-ring, said elastic intermediate being urged and preloaded by a rigid support, said O-ring and associated armature, into a working condition of significant deflection, thereby exerting an adeguate thrust on the O-ring with negligible variations of said thrust due to deflection variations as imposed by the armature rotation and/or manufacturing tolerances.

This arrangement allows the O-ring to be located somewhat offset from the pivot edge of the armature, and hence of the armature pivot axis, so as to apply a convenient and controlled polarization torque thereto, along with an adequate contact force.

According to another aspect of this invention, the elastic intermediate support consists of a plurality of radial leaf springs interconnected by an either internal or external ring element, and being formed from sheet metal as an integral intermediate support.

According to a further aspect of this invention, the O-ring consists of an annular element made of plastics, being highly resistant to compression and having relative torsional elasticity and a prismatic cross-sectional shape, to afford a broad area of contact with the leaf springs and a wedge of contact with said armatures.

According to yet another aspect of this invention, the elastic intermediate support for the O-ring is positioned, relative to the electromagnets, by a cage made of a wear-resistant plastics material.

According to a further aspect of this invention, the positioning cage is movable in the axial direction between two positions so as to preload the leaf springs in a variable manner, and therefore, vary the force exerted by the elastic intermediate support on the O-ring and the armatures, and the associated polarization couple.

In this way, the response of the armatures to the electromagnet energization is changed to provide, with increased leaf spring preloading, shorter overall operation times for the print wires and a faster cycle rate, albeit paid for by a lower impression power.

According to a further aspect of this invention, the positioning cage, movable in the axial direction, will also position and support a resilient damping element which defines the rest position for the armatures, and hence the electromagnet air gaps, with the result that the print wire stroke length is decreased and their rate of operation increased.

BRIEF DESCRIPTION OF THE DRAWINGS

The features and advantages of this invention will become apparent from the following description of a preferred embodiment thereof and the accompanying drawings, in which:

FIG. 4 shows an alternate embodiment of a pressure ring;

FIG. 5 is a diametrical cross-section view of an axially movable positioning cage for a modification of the printhead in FIG. 1;

FIG. 6 is a fragmentary view, taken from above along the axial direction, of the positioning cage in FIG. 5;

FIG. 7 is a sectional view, taken along line I—I in FIG. 6, of the positioning cage and an actuation plate effective to drive the cage axially.

DESCRIPTION OF THE PREFERRED EMBODIMENT

Figure 1:
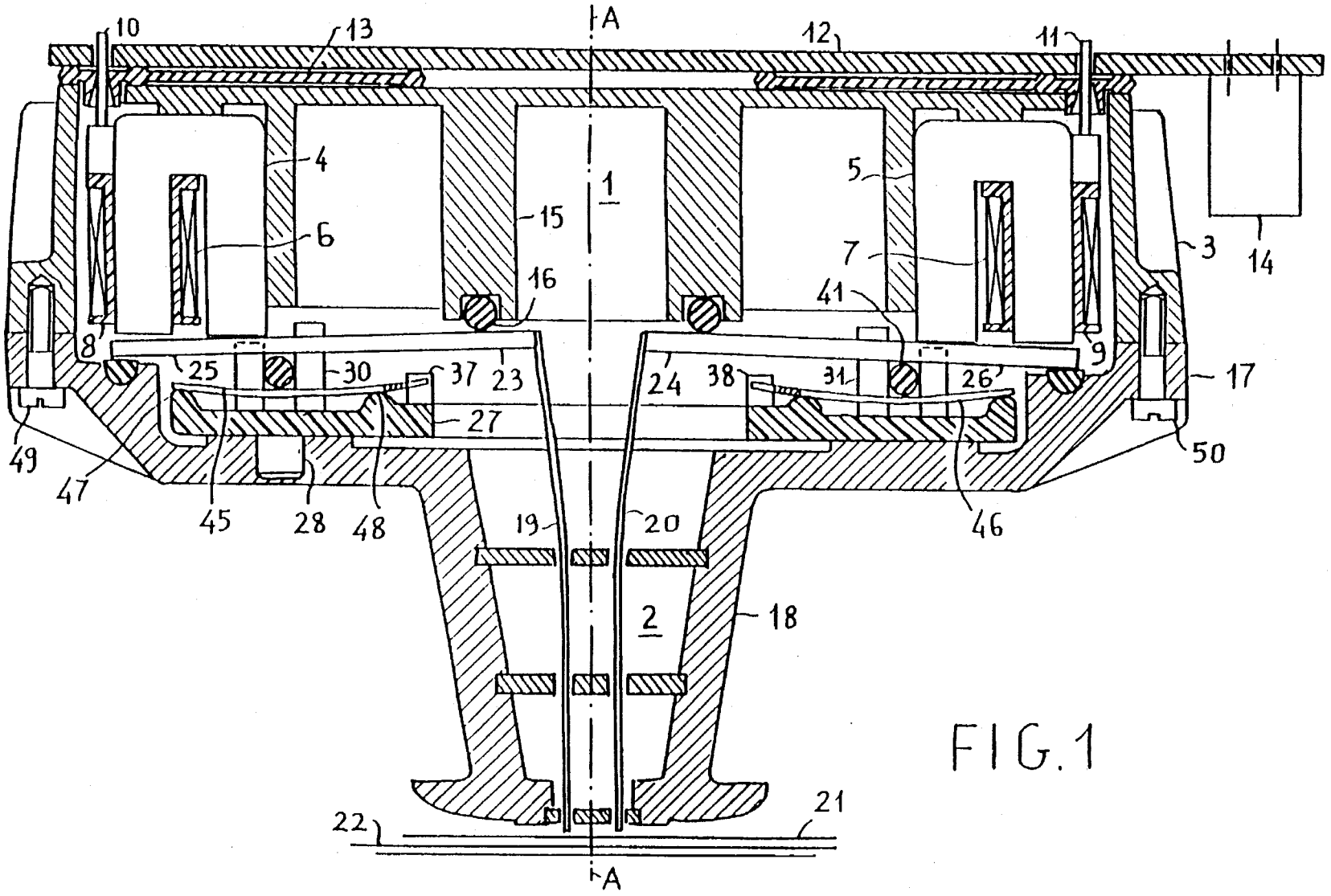
FIG. 1 is a diametrical cross-section view of a preferred embodiment of a wire printhead according to this invention.

With reference to FIG. 1, the printhead of this invention comprises an electromagnet assembly 1 and a wire holder assembly 2.

The electromagnet assembly 1 consists of a metal shell 3 in the form of a cylindrical cup having a center axis A—A corresponding to the printhead axis. Distributed circumferentially within the shell are a plurality of magnetic cores, two such cores 4,5 being shown in FIG. 1.

Each core comprises a yoke, an inward (relative to the axis A—A) pole pillar, and an outward pole pillar.

Fitted over at least one of the pole pillars of the various magnetic cores is an excitation winding 6, 7 wound around a reel 8,9 and having terminals 10, 11 for connecting the winding, as by soldering, to a printed circuit board 12 disposed close to the cup bottom and held off it by an interposed insulating diaphragm 13.

The printed circuit board 12 is provided with a connector 14 for connection to control circuits for the electromagnets.

The magnetic cores and associated windings are secured within the metal shell either by driving into appropriate sockets or encapsulating them in thermosetting resin, and the pole piece ends are all ground to be coplanar and present a flat abutment surface for their respective armatures when in the attracted state.

A cylindrical inner turret 15 provides a housing for a resilient bearing element 16, preferably an O-ring, intended for the actuator arm of the various armatures.

The wire holder assembly 2 also includes a shell, made preferably of metal, in the form of a cylindrical cup 17 which is terminated downwardly into an axial tip 18 whereto a plurality of impression wires 19, 20 are guided along a substantially parallel direction to the printhead axis, the wires having one end extended beyond the tip to press an inked ribbon 21 against a platen 22.

The other ends of the needles are each welded or soldered to the end of an actuator arm 23, 24 of a corresponding electromagnet armature 25, 26.

A cage 27 having a flattened annular shape, about a corresponding axis to the printhead axis, is housed within the cup 17.

Locating pins 28 for the cage 27 are fitted inside corresponding sockets on the cup 17.

Figure 2:
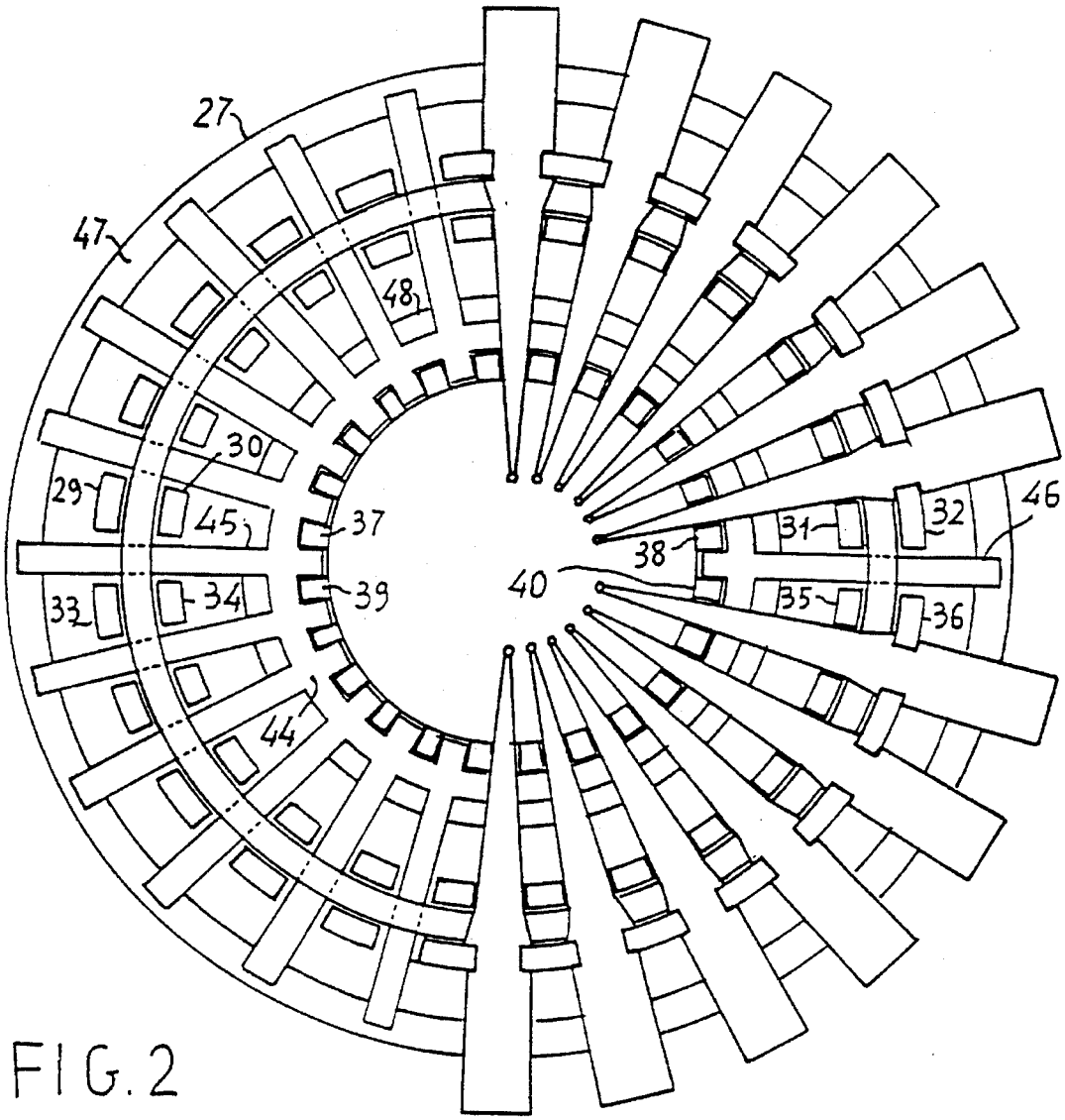
FIG. 2 is a view from above, taken along an axial direction, of an armature positioning cage, resilient pressure rings, and biasing leaf springs for the printhead in FIG. 1.

As brought out by FIGS. 1 and 2, the cage has plural tenons 29, 30, 31, 32, 33, 34, 35, 36, 37, 38, 39 and 40 arranged into rings around three concentric circumferences and extending perpendicularly to the plane of the cage.

The tenons 29–36 are arranged around the two outermost circumferences and define a ring-shaped housing for a resilient O-ring element 41.

Tenon pairs in one ring and belonging to the outermost rings also define radial locating housings for the individual armatures on the heads of respective electromagnets.

The tenons 37–40 in the innermost ring, being less prominent than the rest, will not interfere with the movements of the actuator arms, and will define as pairs a plurality of housings for a corresponding plurality of teeth 42, 43 of an elastic spider element 44 formed from flat sheet metal whose spokes, such as 45, 46, form each one leaf spring resting with its ends on ring-shaped elevations 47, 48 on the cage 27.

The leaf springs intervene between the cage 27 and the O-ring 41, each juxtaposed to a corresponding one of the armatures to provide an intermediate support having a comparatively low elastic constant.

The wire assembly 2 can be easily put together by placing the cage 27, leaf spring spider 44, O-ring, and electromagnet armatures complete with their wires and actuator arms, in this order inside the shell 17.

The assembled wire assembly 2 is then attached fixedly to the electromagnet assembly 1 by means of screws 49, 50 or some other suitable fasteners.

In the course of this operation, the armatures will interfere with the electromagnet heads and be constrained into a rest position with the ends of their respective lever arms bearing on the resilient abutment element 16 under the thrust applied by the O-ring, as a result of the elastic deformation of the now preloaded leaf springs.

The components may be sized such that the leaf springs are imparted a significant deflection, as provided by each leaf spring applying an adequate thrust force on its corresponding armature, through the O-ring, to keep the armature in contact with the innermost edge of the innermost pole pillar end of the corresponding electromagnet.

The deflection may be one or more orders of magnitude greater than possible manufacturing tolerances for the pieces, thereby rendering any thrust variations due to such tolerances negligible with respect to a desired nominal design thrust.

This is obviously impossible to achieve with conventional printheads wherein this contact force is obtained by elastic deformation of the O-ring only.

Thus, in these printheads, the O-ring 41 is located as close as possible at the lever fulcrum of the armatures to prevent the O-ring from applying uncontrollable polarization moments to the armatures.

The armature polarization task is, therefore, assigned to other elements, usually coil springs associated with each of the wires, which brings about the previously mentioned drawbacks.

On the other hand, according to the embodiment of this invention, the polarization moment can be applied through the O-ring as conveniently offset from the fulcrum.

Figure 3:
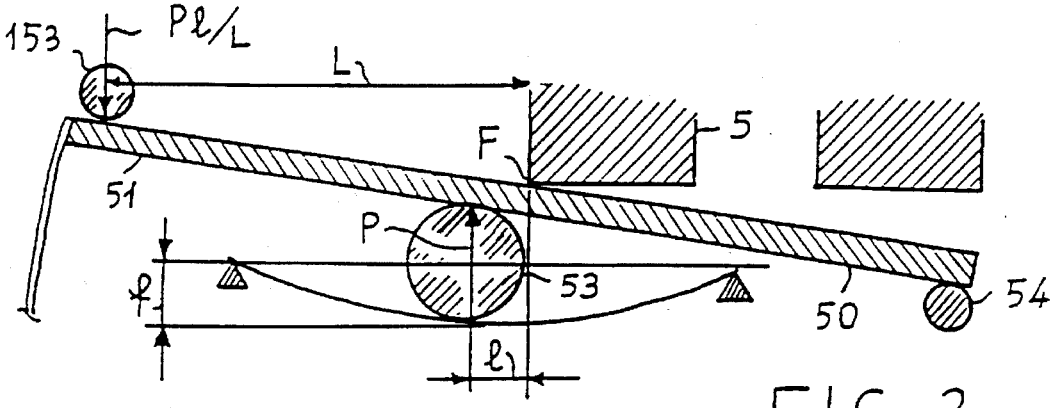
FIG. 3 is a force diagram illustrating the interactions of an armature, an electromagnet, a resilient pressure ring, and a polarization leaf spring for the printhead in FIG. 1.

As may be appreciated from the kinematic diagram of FIG. 3, an armature 50 pivoted at F (the magnetic core edge) would then undergo a thrust P applied to the arm 51 of a leaf spring 52 through the O-ring 53, a distance l away from the fulcrum F.

The armature 50 and arm 51 are, therefore, subjected to a moment P*l.

Since T=K*f, where f is the leaf spring deflection, and K is its elastic constant, variations in the deflection f which be one or more orders smaller than f, would not affect the moment magnitude appreciably, and the moment can be given a suitable value by an appropriate selection of K and l.

The armature rest position and the air gap are defined by a resilient element 153, corresponding to element 16 in FIG. 1, on which the end of the arm 51 will bear.

Alternatively or concurrently therewith, the rest position may be defined by a resilient element 54 (preferably an O-ring encompassing all the armatures) on which the free end of the armature 50 would bear.

It should be noted that the provision of a resilient O-ring 41 (FIG. 1) to hold the armature against the pole piece ends of the electromagnet is needed in prior art approaches, but only optional in this invention, the O-ring merely serving here to define the point of application of the force P and to prevent wear of the contact point.

According to another aspect of this invention, as diagramatically shown in FIG. 4, the O-ring 42 is replaced with a ring-shaped element 155 made of a plastics material resistant to compression and wear and having a basically prismatic cross-sectional shape, so as to present a flat abutment surface 255 contacting the various leaf springs and a suitably rounded contact wedge 55 contacting the various leaf springs, thereby defining the exact point of application of the force P and its moment.

It should be further noted with reference to FIG. 1 that the cage 27 is also conveniently made of a wear-resistant plastics material to sustain the bonding and locating function that the tenons are to provide for the moving elements formed by the armatures.

The shell 17 acting as a holder for the wire assembly is preferably made of a light metal alloy, as is the shell containing the electromagnets, to afford good thermal conductivity and effective dissipation of the heat generated by the electromagnets.

It may be appreciated that if the heat dissipation function is only intended for the electromagnet assembly and the shell 17 is made of plastics, as is usually the case with low-priced printheads, then the cage 27 can be formed integrally with the shell 17.

However, its implementation as a discrete element will offer further important advantages, additionally to the aforementioned advantage of enabling a metal structural element to be used for holding the wires and armatures.

In fact, according to a further aspect of this invention, shown in FIGS. 5, 6 and 7, the cage 27 can be moved axially between two positions such that the leaf springs will be deflected to a greater or lesser extent and apply a varying moment to the armatures dependent on how close it has been brought to the electromagnets.

The armature dynamic response to energization of the electromagnets can, therefore, be tailored to different operation requirements, specifically that of printing on thin individual sheets, which would require low impression power, or printing several copies, which would require a higher impression power.

Of course, as the resisting moment applied to the armatures by the leaf spring increases, the wire propelling time will also increase and the impact velocity (and hence the amount of kinetic energy converted to impression energy) will decrease.

However, the return time of the wires and the armatures to their rest positions is bound to decrease by a much greater extent, thereby reducing the overall operation time and allowing a higher impression rate to be used, albeit at the expense of lower impression power.

This is accomplished by providing the flat face of the cage remote from that carrying the leaf springs with a plurality of radial teeth 56, 57 and 58 having a trapezoidal cross-section and being interspersed with a corresponding plurality of radial recesses 59, 60 and 61 whose cross-sectional shapes match those of the teeth.

The tooth height may conveniently be on the order of a few tenths of a millimeter.

Placed between the cage 27 and the flat bottom of the shell 17 is a metal plate 62 of annular shape, which has suitable dimensions, for example, equal to those of the cage 27, and thickness, e.g. of 0.5 mm, it being also provided with a plurality of radial teeth identical in shape and size with those on the cage 27.

The plate 62 is formed with circumferential slots, as at 63, wherethrough the pins 28 of the cage 27 are passed.

The slots 63 are effective to locate, in co-operation with the pins 28, the plate 62 axially with respect to the cage 27 and the shell 17, and to allow the plate to be rotated a predetermined angle about its axis.

Through this rotation, the plate teeth can be moved, from a position where they fit into the cage recesses, to a position where they are juxtaposed to the cage teeth and shift them axially toward the armatures by a distance equal to the tooth height.

To control this movement, the plate 62 is conveniently provided with a peripheral L-shaped lug 64 whose end juts out of the shell through a convenient slot opening 65.

Actuator devices external of the printhead and not shown can act on the lug 64 to drive the plate 62 to either position.

For instance, it being recognized that a printhead of the kind described would be usually mounted on a printing carriage running along guide rails, the actuation may be obtained through travel limit elements which would, utilizing the relative motion of the printhead, respectively move the lug in either directions.

The actuation may also be accomplished by combining the printhead motion with the operation (e.g. through an electromagnet) of a pin to interfere with the lug 64 during the printhead movement along the guide rails.

In order to reduce the frictional resistance between the plate 62 and the shell 17, a sheet 85 of an anti-friction plastics, such as a polyester, polyamide (Nylon) or polytetrafluoroethylene (Teflon), may be provided between those two elements.

Figure 8:
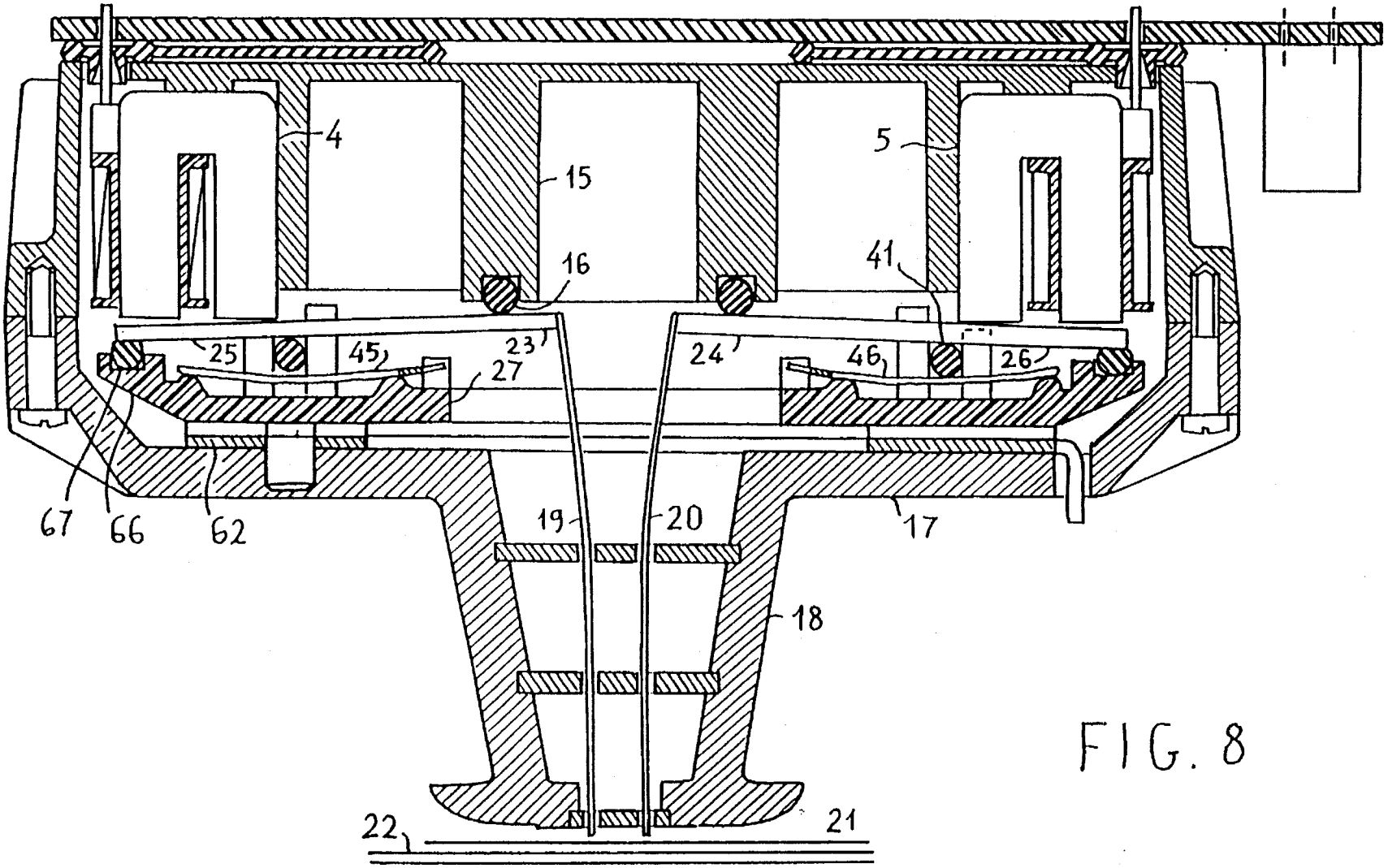
FIG. 8 is a diametrical cross-section view showing a modification of the printhead incorporating the devices of FIG. 7.

FIG. 8, which is similar to FIG. 1, shows a further possible improvement on prior art printheads, which results from the use of a moving cage to vary the armature polarization moments.

It is known, e.g. from European Publication EP-A-418433, that to optimize the performance of a printhead to suit the thickness of the impression substrate and the number of copies to be printed, a device can be arranged to so alter the air gap, with the armatures at rest, as to adjust the wire stroke for different operation situations.

According to one aspect of this invention, that additional function can be easily provided by using a cage 27 which be movable axially and formed with a peripheral socket outside the leaf springs 45 and 46 for receiving a resilient stop against which the armature free ends will abut.

As shown in FIG. 8, where equivalent elements to those shown in FIG. 1 are denoted by the same reference numerals, the cage 27 is extended peripherally into a ring-shaped bracket 66 accommodating an O-ring 67.

The cage 27 has its flat lower face formed with teeth as previously described in connection with FIGS. 5, 6 and 7.

Placed between the cage 27 and the shell 17 is an annular plate 62, also toothed complementarily of the cage 27 and operable to set its teeth in between the recesses on the cage 27 at a juxtaposed position to the teeth thereof.

Thus, the cage 27 is made movable axially between two positions through a travel distance which is equal to the tooth height.

With the cage 27 in the farthest position from the electromagnet assemblies, the leaf springs will each be applying a thrust P1 and moment M1 to each of the armatures, holding them in a rest position defined by an abutment element 16 interfering with the ends of the armature actuator arms.

In that position, the O-ring 67 would be non-interferent with the free ends of the armatures, and the armature gap H1 be solely decided by the element 16.

With the cage 27 in the closest position to the electromagnet assembly, the leaf springs will each be applying a thrust P2>P1 and a moment M2>M1 to each of the armatures, holding them in a rest position that, in this case, may be defined by the armature free ends interfering with the O-ring 67, which O-ring would impose a gap H2<H1 on the armatures.

The gap variation H is not necessarily correlated and equal to the tooth height and the axial stroke length of the cage, which may be selected to just suit the moment M variation sought.

The gap variation H is only dependent on the O-ring 67-to-armature interference, which may be selected to have any possible value smaller than the stroke length of the cage 27.

A printhead like that shown in FIG. 8 allows, therefore, two parameters of special significance, namely the polarization moment applied to the armatures and the gap, to be varied independently.

Additionally to this parameter varying feature, the excitation characteristics of the electromagnets can be obviously changed.

The net outcome of all this is a printhead which is simple and compact in construction, has its wires integral with the armatures, is highly versatile, and can fill a variety of operational demands with optimum performance.

The foregoing description only covers some preferred embodiments of the invention, and many changes may obviously be made thereunto.

In particular, the electromagnetic assembly 1 may be a unitized block formed by encapsulating the electromagnets and the printed circuit under plastics, doing away with need for a metal housing shell.

Also, the shell 18 and tip 18 containing the wires and armatures may be made of plastics instead of metal.

Additionally, the toothed plate actuating the cage 27 may be replaced with a slide-like element or any other equivalent device effective to displace the cage 27 axially.

I claim:

1. A wire print head comprising a plurality of electromagnets and a corresponding plurality of armatures, each of said armatures being juxtaposed to a corresponding electromagnet and journaled thereto at an edge of said corresponding electromagnet thereby forming a related fulcrum for said corresponding armature, each of said corresponding armatures being provided with an actuation arm that extends away from said related fulcrum to form a lever of the first order for actuating an impression wire that is attached to a free end of said actuation arm;

a resilient element for holding each of said levers in contact with said related fulcrum, said resilient element being offset from said fulcrum a predetermined distance in the direction of said actuation arm; and a plurality of preloaded leaf springs applying, each through said resilient element, offset from said fulcrum, a predetermined polarization moment to a related one of said levers, said moment biasing said levers in a first rest position defined by a first abutment element for the free end of said levers.

2. A wire print head according to claim 1, wherein said electromagnets and said levers are radially distributed about a center axis, said armatures forming the outermost portion of said levers relative to said axis, said leaf springs being interconnected at one of their ends by a ring shaped element into a unitary leaf spring spider element lying perpendicularly to said axis.

3. A print head according to claim 2, wherein said resilient element is an O-ring.

4. A print head according to claim 2, wherein said resilient element is a ring of wear-resistant material having a prismatic cross section, a bearing surface for said leaf springs and a pressure contact wedge for said levers.

5. A print head according to claim 2, further including a cage of wear resistant material for supporting said leaf spring spider element including a flat ring shaped element coaxial with said axis, provided with a plurality of locating tenons arranged in a plurality of rings and housed within a shell containing said armatures, said actuator arms and said wires, said tenons positioning said leaf spring spider element, said resilient element and said armatures on said cage, said spring spider element being interposed between said flat ring shaped element of said cage and said resilient element.

6. A print head according to claim 5, further including means for shifting said cage in the direction of said axis between predetermined firs and second axial positions.

7. A print head according to claim 6, wherein said shifting means comprise a ring shaped element, housed i said shell and interposed between said cage and said shell, rotatable on said axis relative to said cage and said shell in a first and second angular position and having raised radial teeth cooperating with redial teeth of said cage for imposing said first axial position to said cage when rotated in said first angular position and said second axial position when rotated in said second angular position.

8. A print head according to claim 6, where said free end of said levers in abutment with said first abutment element is the free end of said actuation arms and said cage comprises a second ring shaped abutment element for the outermost free end of said armatures, said second abutment element being driven by said cage, when said cage is located in one of said predetermined axial positions, to interfere with said armatures and define a second rest position for said levers.

* * * * *